US007190913B2

(12) United States Patent
DiRubio et al.

(10) Patent No.: US 7,190,913 B2
(45) Date of Patent: Mar. 13, 2007

(54) TONER MONITORING SYSTEMS AND METHODS

(75) Inventors: Christopher A. DiRubio, Webster, NY (US); Antonio DeCrescentis, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 225 days.

(21) Appl. No.: 11/095,794

(22) Filed: Mar. 31, 2005

(65) Prior Publication Data

US 2006/0222388 A1 Oct. 5, 2006

(51) Int. Cl.
*G03G 15/00* (2006.01)
*G03G 15/08* (2006.01)
*G03G 15/16* (2006.01)

(52) U.S. Cl. ..... 399/49; 399/29; 399/66

(58) Field of Classification Search ..... 399/27–30, 399/49, 66

See application file for complete search history.

(56) References Cited

U.S. PATENT DOCUMENTS 5,559,593 A * 9/1996 Yoshinaga et al. ..... 399/343

FOREIGN PATENT DOCUMENTS

JP 2004117968 A * 4/2004

* cited by examiner

*Primary Examiner*—David M. Gray
*Assistant Examiner*—Ryan Gleitz
(74) *Attorney, Agent, or Firm*—Gibb I.P. Law Firm, LLC

(57) ABSTRACT

Embodiments herein generally relate to printing systems and methods that use toner and more particularly to a system and method that observes the distribution, for different levels of transfer field, of mass per area of toner remaining on the drum/belt as the drum/belt transfers the toner. The distribution is compared to predetermined standards and/or other networked printing systems to evaluate characteristics of the toner. Actuators can then be used to improve the toner characteristics resulting in improved print quality within a printing system and improved printing consistency between internally or externally networked printing systems and/or marking engines.

26 Claims, 9 Drawing Sheets

| AVERAGE | DEVIATION |
|---|---|
| 1295.7 | 753.0 |

| FOR TONER A EXPERIMENT | | | | | | |
|---|---|---|---|---|---|---|
| [V] | [V] | [μA] | [V] | [V] | [V] | [V/um] |
| Avg Vhi | VBTR-Vhi | IBTR | VBTR | Vlow | VBTR-Vlow | Epeak |
| -639 | 639.618 | -0.027 | 0.618 | -299.7 | 300.318 | 8.09 |
| | 839.505 | 0.465 | 200.505 | -302 | 502.505 | 11.47 |
| | 1140.9 | 0.294 | 501.9 | -302.1 | 804 | 16.57 |
| | 1492.83 | 1.06 | 853.83 | -302.1 | 1155.93 | 22.52 |
| | 1679.92 | 2.06 | 1040.92 | -296.3 | 1337.22 | 25.69 |
| | 1807.29 | 3.03 | 1168.29 | -296.3 | 1464.59 | 27.84 |
| | 2055.06 | 5.05 | 1416.06 | -296.3 | 1712.36 | 32.04 |
| | 2478.45 | 9.89 | 1839.45 | -302.1 | 2141.55 | 39.20 |
| | 2925.8 | 14.99 | 2286.8 | -296.3 | 2583.1 | 46.77 |
| | 3213.98 | 20.07 | 2574.98 | -302.1 | 2877.08 | 51.64 |
| NOMINAL | 3527.46 | 24.99 | 2888.46 | -296.3 | 3184.76 | 56.95 |
| | 3788.919 | 29.916 | 3149.919 | -299.7 | 3449.619 | 61.37 |
| | 4249.791 | 40.049 | 3610.791 | -299.7 | 3910.491 | 69.17 |
| | 4652.558 | 50.067 | 4013.558 | -302 | 4315.558 | 75.98 |

FIG. 5

TONER MONITORING SYSTEMS AND METHODS

BACKGROUND AND SUMMARY

Embodiments herein generally relate to printing systems and methods that use toner and more particularly to a system and method that observes the statistical distribution, for different levels of the transfer field, of mass per area of toner remaining on the drum or belt as the drum/belt transfers the toner. The distribution is compared to predetermined standards and/or other networked printing systems to evaluate characteristics of the toner.

Embodiments herein are equally useful with a drum photoreceptor (or dielectric), as with a belt (photoreceptor or dielectric), and other similar devices. Photoreceptor based engines use light to discharge areas and create the latent image, where the latent image is the charge pattern corresponding to image, while dielectic based engines write the latent image directly onto dielectric. Toner properties can drift over time in a printing engine, negatively impacting system performance, latitude, and print quality stability. In order to maintain stable performance, a printing engine uses process control schemes employing optical density sensors as well as other types of sensors (color engines may have multiple toner control sensors and optical density sensors). Improvements in the measurement of the toner state would enable more advanced control schemes that could result in improved print quality and stability (over time, station to station, and engine to engine including printers having multiple marking engines within one printer or a group of printers networked into a cluster).

Thus, embodiments herein comprise systems that are adapted to monitor toner in a printing engine. The systems include a first device, such as a drum or a belt (which is sometimes referred to herein as a drum/belt) containing a latent image (charge pattern), and a toner source adapted to supply toner to develop the latent image on the drum/belt. A surface such as a transfer belt or printing medium is adjacent to (and/or in contact with) the drum/belt and transfer of the toner from the drum/belt to the surface is achieved by generating a transfer field through the operation of a charged, biased transfer device.

While the drum/belt is designed to transfer all of the toner to the surface, in reality, a small amount of toner remains on the drum/belt and, therefore, the drum/belt sometimes transfers less than all of the toner to the surface. To detect the amount of toner that remains on the drum/belt, embodiments herein place a toner area coverage sensor adjacent the drum/belt to measure the mass per area of toner remaining on the drum/belt just after the drum/belt transfers toner to the surface. Also a controller is connected to the toner area coverage sensor and to the charged transfer device. The controller controls the toner area coverage sensor to detect the mass per area of toner remaining on the drum/belt as (just after) the drum/belt transfers the toner to the surface, while varying the transfer field generated by the charged transfer device. If, in addition to (or instead of) generating an electric field, the transfer device uses heat or some other type of actuator (e.g. ultrasonic energy) to achieve transfer, then these transfer actuators could also be varied.

A calculator unit is provided to calculate a field detachment distribution based on changes in the mass per area of toner remaining as the transfer field of the charged transfer device is varied. The field detachment distribution is a statistical function of the remaining mass per area percentage versus the transfer field (charge or voltage) which can be plotted as a curve on graph. In addition, a comparator compares the field detachment distribution to a predetermined standard to evaluate characteristics of the toner. The comparator can detect a difference between a mean detachment field and a predetermined mean detachment field. The toner will have specific characteristics at the mean detachment field and, if this value shifts, this indicates that the characteristics of the toner have also shifted.

Similarly, the comparator can detect the difference between a probability density function of the measured field detachment distribution and a predetermined field detachment distribution probability density function. Also, the comparator can detect the difference between a stabilization toner mass per area (remaining after the transfer field reaches a stabilization point where the mass per area is minimized) and a predetermined stabilization toner mass per area; and can detect the difference between an observed maximum transfer field and a predetermined maximum transfer field. Again, the toner will have specific characteristics for a given field detachment distribution probability density function; different characteristics for the different stabilization toner masses per area; different characteristics for the different maximum transfer fields and other similar measures of the field detachment distribution. If any of these values shift, this indicates that the characteristics of the toner have also shifted. In response to changes in the characteristics of the toner, the system can alter the operating parameters of the printing engine.

While the foregoing discusses the system with respect to comparisons with predetermined values and standards, the system can also be utilized with relative comparisons of similarly operating machines. For example, sometimes groups of printing engines will be networked together and some printers use multiple marking engines within a single print engine. The printing from each of the different engines should be consistent so that there is little or no variation from printing engine to printing engine. For such printing networks, the controller can alter the operating parameters of the printing system based on comparisons of the different field detachment distributions of the different printing engines within the printing network. Thus, the controller can monitor toner attributes in a plurality of different printing devices, compare the toner attributes, and alter operating parameters of the printing devices depending upon the comparing of the toner attributes to promote printing uniformity between the different printing devices.

These and other features are described in, or are apparent from, the following detailed description.

BRIEF DESCRIPTION OF THE DRAWINGS

Various exemplary embodiments of the systems and methods described in detail below, with reference to the attached drawing figures, in which:

FIG. 5 is a table illustrating the field at various $V_{BTR}$–$V_{LOW}$ set points;

DETAILED DESCRIPTION

Figure 1:
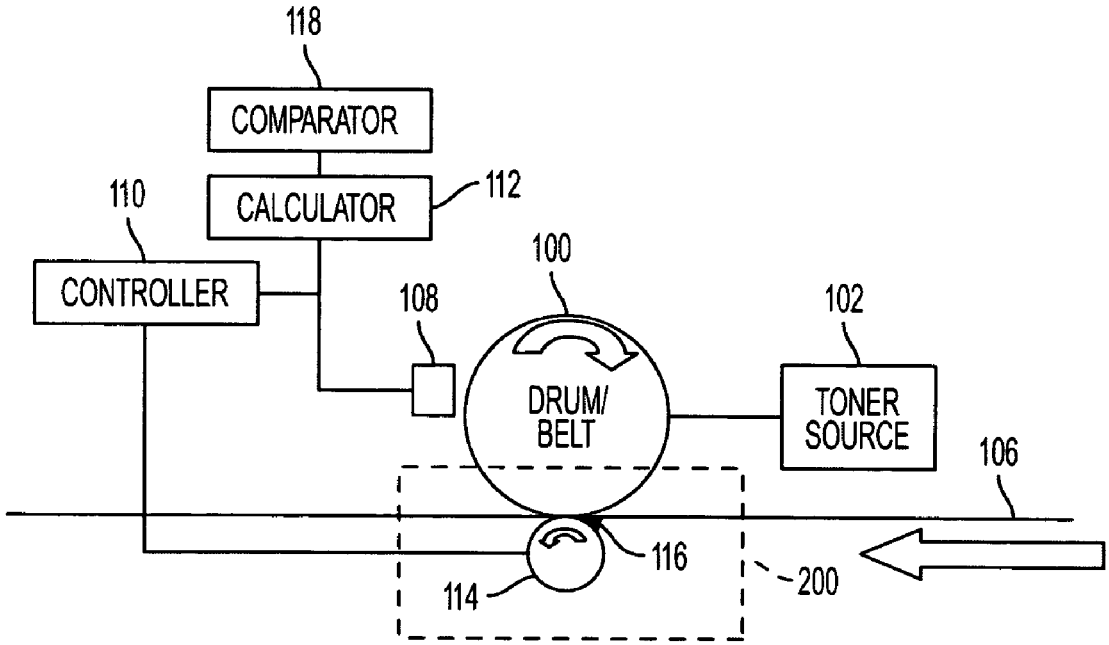
FIG. 1 is a schematic representation of a system for monitoring toner characteristics in a printing engine.
Figure 2:
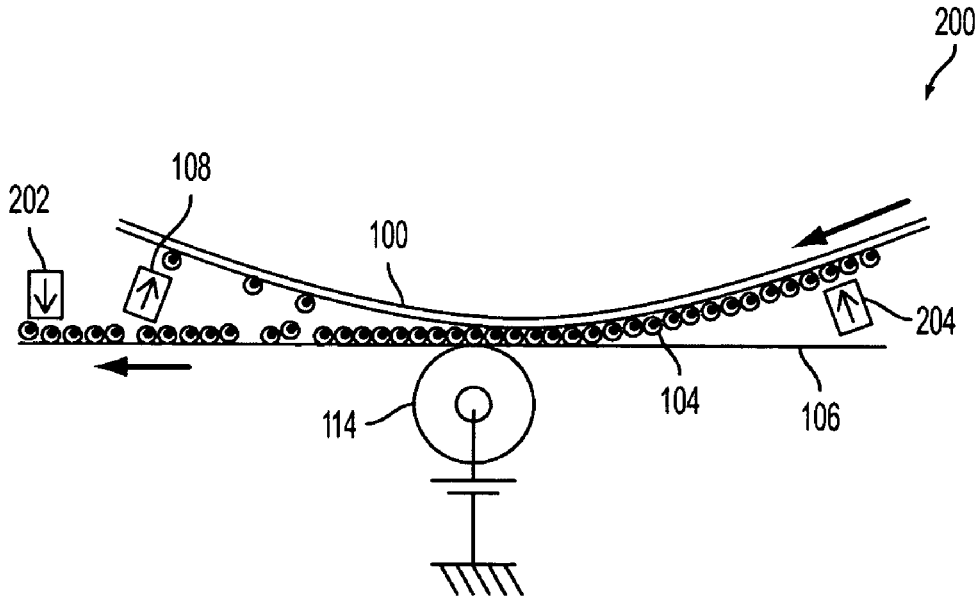
FIG. 2 is a more detailed schematic representation of the printing engine shown in FIG. 1.

As mentioned above, embodiments herein comprise systems that are adapted to monitor toner characteristics (such as toner tribo, toner charge distribution, toner size, toner shape distribution, toner additive state, toner age, and other similar characteristics) in a printing engine, and a schematic diagram of one such system is shown in FIGS. 1 and 2. More specifically, FIG. 2 is a more detailed view of the portion of the structure in FIG. 1 shown in the dashed box 200.

The system shown in FIGS. 1 and 2 includes a first device, such as a drum or belt (drum/belt) 100, and a toner source 102 adapted to supply toner 104 to the drum/belt 100. A surface 106 such as a transfer belt or printing medium/substrate, is adjacent to (and/or in contact with) the drum/belt 100 and the toner 104 is transferred to the surface 106 with the assistance of a charged transfer device 114. More specifically, by operation of the charge induced into the belt/substrate 106 by the charged transfer device, oppositely charged toner 104 is attracted from the drum/belt 100 to the belt/substrate 106 as the belt/substrate 106 passes through the nip 116 created between the drum/belt 100 and the charged transfer device 114. The toner 104 remains on the belt/substrate 106 after it passes through the nip 116, and is later transferred to a different substrate and/or fused to the printing medium/substrate 106.

While the drum/belt 100 is designed to transfer all of the toner 104 to the surface 106, in reality, a small amount of toner 104 remains on the drum/belt 100 and, therefore, the drum/belt 100 sometimes transfers less than all of the toner 104 to the surface 106. To detect the amount of toner 104 that remains on the drum/belt 100, embodiments herein place either a toner area coverage sensor 108 or a similar sensor sensitive to the toner coverage adjacent the drum/belt 100 to measure the mass per area of toner remaining on the drum/belt 100. This sensor 108 is referred to as a residual mass/area (RMA) sensor because it measures the mass of residual toner 104 per a given area remaining on the drum/belt after the drum/belt rotates/moves past the nip 116. The structure can optionally include additional sensors such as a transfer mass/area (TMA) sensor 202, that measures the amount of toner 104 that is transferred to the substrate 106, and a developed mass/area (DMA) sensor 204 that detects the amount of toner 104 that is on the drum/belt 100 before the toner 104 is transferred to the substrate 106 (the amount of toner 104 that was transferred to the drum/belt 100 from the toner source 102).

Also a controller 110 is connected to the toner area coverage sensor 108 and to the charged transfer device 114. The controller 110 controls the toner area coverage sensor 108 to detect the mass per area of toner 104 remaining on the drum/belt 100 as the drum/belt 100 transfers the toner 104 to the surface 106, while varying the transfer field of the charged transfer device 114.

A calculator unit 112 is provided to calculate a field detachment distribution based on changes in the mass per area of toner remaining as the transfer charge of the charged transfer device 114 is varied. The field detachment distribution is a statistical function of the remaining mass per area percentage versus the transfer field (charge or voltage) which can be plotted as a curve on graph, as shown for example, in FIG. 3. In addition, a comparator 118 compares the field detachment distribution to a predetermined standard to evaluate characteristics of the toner 104. If the characteristics of the toner 104 shift, the toner may need to be replaced, fresh toner may need to be dispensed to the development station, additional additives to the toner may be dispensed to the development station, the operational parameters of the printing engine may need to be modified, and/or other similar measures may need to be taken in order to maintain high quality and consistent printing operations.

The comparator 118 can detect a difference between a mean detachment field (FIG. 4, discussed below) in the measured field detachment distribution and a predetermined mean detachment field. In one exemplary embodiment, this process proceeds by measuring the RMA vs. the field, followed by a mathematical fit to extract the cumulative distribution function (CDF, shown as item 302 in FIG. 3, discussed below) and the probability density function (PDF, item 304 in FIG. 3) for the toner. Then this process compares the mean of the CDF and the width of the PDF (etc.) to predetermined values or values from other networked engines. Then, the operating parameters of the marking engine are changed to bring the distributions closer to target values.

The toner 104 will have specific characteristics at the mean detachment field, and if this value shifts, this indicates that the characteristics of the toner 104 have also shifted. Similarly, the comparator 118 can detect the difference between the width of a probability density function (also sometimes referred to herein as the "detachment distribution width" or "slope of the cumulative distribution function" as discussed below with respect to FIG. 4) of the measured field detachment distribution and a predetermined field detachment distribution probability density function. Also, the comparator 118 can detect the difference between a stabilization toner mass per area (remaining after the transfer charge reaches a stabilization point and the mass per unit area is minimized) and a predetermined stabilization toner mass per area; and can detect the difference between an observed maximum transfer field and a predetermined maximum transfer field. Again, the toner 104 will have specific characteristics for a given field detachment distribution probability density function; different characteristics for the different stabilization toner masses per area; different characteristics for the different maximum transfer fields and other similar measures of the field detachment distribution. If any of these values shift, this indicates that the characteristics of the toner 104 have also shifted. In response to changes in the characteristics of the toner 104, the system can alter the operating parameters of the printing engine.

The sensors 108, 202, 204 can comprise optical density sensors, ETAC (Enhanced Toner Area Coverage) sensors or the equivalent (full width array sensors). Alternately DMA (developed mass/area) could be measured instead of TMA. DMA could be measured either by sensor 204, or sensor 204 could be eliminated and RMA sensor (108) could be utilized to measure DMA by briefly operating the transfer device so that no toner is transferred to the substrate (i.e. RMA=DMA). This technique has the advantage of eliminating the need for sensors 202 and 204. The embodiments herein measure RMA directly for accuracy. Either of the following equations can be used to generate the curve.

$$\%\,RMA = \frac{100 * RMA}{DMA} = \frac{100 * RMA}{TMA + RMA}$$

Measuring DMA may be preferable to measuring TMA if the substrate is paper (as opposed to an intermediate transfer belt). The transfer field could be determined by measuring a suitable surrogate (e.g., $V_{BTR}-V_{LOW}$ for a BTR, where $V_{BTR}$ is the bias applied to the Biased transfer Roll and $V_{LOW}$ is the potential of the drum/belt in the areas containing toner, or by measuring dynamic current ($I_{DYN}$) for a corotron).

A simplified method for transfer field determination measures an appropriate surrogate for the field. In the case of a corotron, the peak transfer field is directly proportional to $I_{DYN}$;

$$E_{PEAK} = \frac{I_{DYN}}{Lv_{PROCESS}\varepsilon_0}$$

where L is the process width, v is the process speed, and $\in_0$ is the permittivity of free space). In the case of a contacting biased transfer system like a BTR or transfer belt, the peak field is proportional to $V_{BTR}-V_{LOW}$. In general it would probably not be necessary to measure $V_{LOW}$ since typically $V_{BTR}>>V_{LOW}$. A simple analytic expression can be used to estimate the field more accurately. The equivalent dielectric thickness of the biased transfer element and the substrate would have to be determined by measuring the dynamic current and applied voltage at one (or a few) point(s) along the dynamic IV curve. With this information, the field could be estimated more accurately, if necessary.

Figure 3:
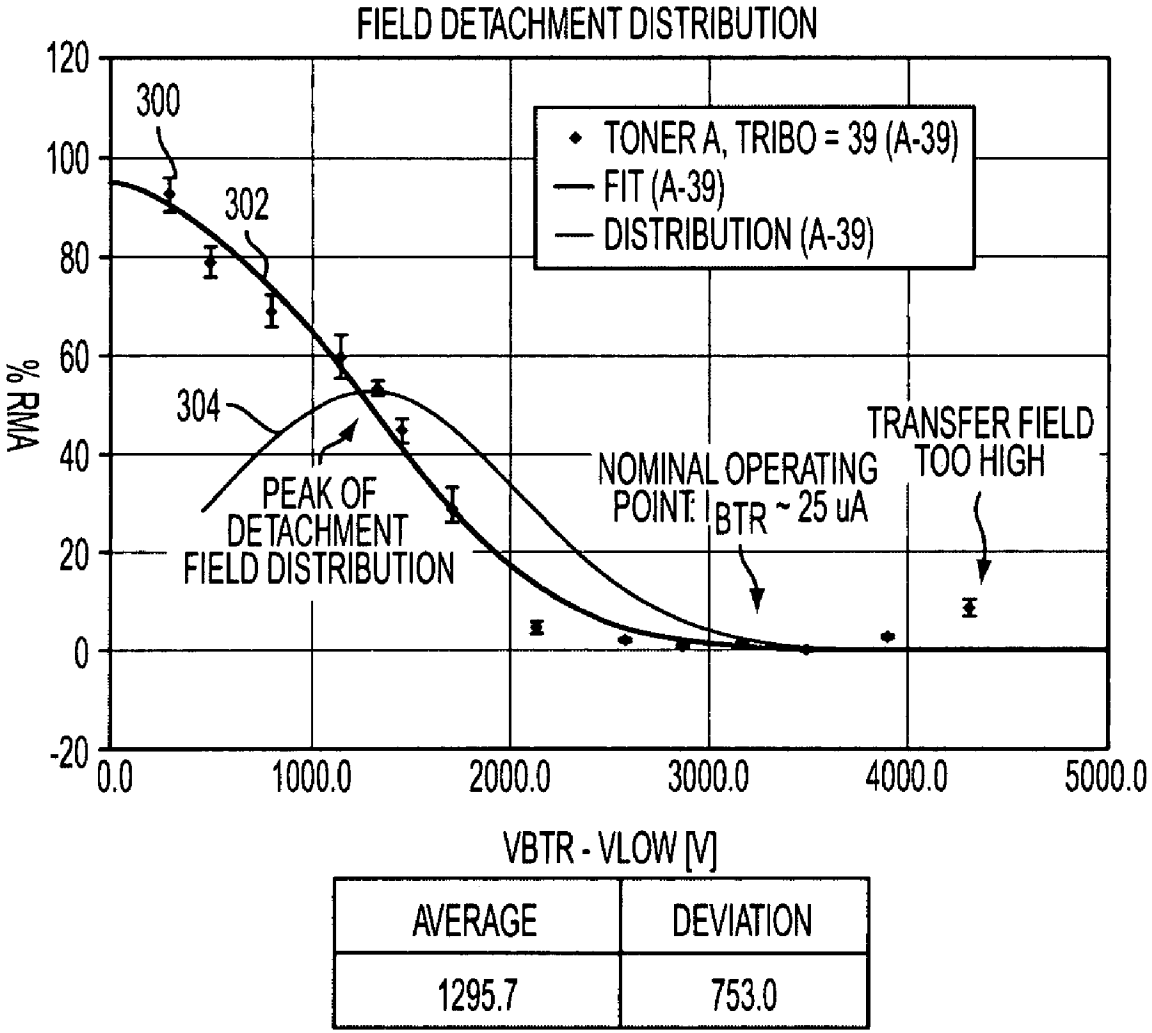
FIG. 3 is a graph illustrating information on measured RMA as a function of transfer field.

FIG. 3 illustrates information on measured RMA as a function of transfer field and is used as baseline for the examples shown in FIGS. 4–9. The information in FIG. 3 was gathered in a manual process and is used for comparison purposes with (and to demonstrate the effectiveness of) the information obtained with the toner area coverage sensors that are shown in FIGS. 4–9.

The transfer RMA as a function of transfer field is plotted as curve 302 in FIG. 3 for a fresh spherical toner in a color printing engine. In this example, the tribo of the toner is 39 μC/g and it is therefore referred to as (A-39) toner in FIG. 3. The toner was transferred from the OPC drum/belt to the intermediate belt, and the RMA and DMA were measured off of the drum/belt and belt using a combination of suck-offs and tape transfers (manual processing, without sensors). Only 100% solid area patches were used with DMA~0.5 mg/cm$^2$. Ideally all of the toner should transfer from the drum/belt 100 to the substrate 106. In the plot $V_{BTR}-V_{LOW}$ is used as a surrogate for the transfer field, where $V_{BTR}$ is the bias applied to the biased transfer Roll and $V_{LOW}$ is the potential of the drum/belt in the areas containing developed toner.

In FIG. 3, the actual data points (which have a range for the various samples collected) are shown as items 300. The curve 302 is the RMA(E), where RMA(E) is 100–CDF(E), and CDF(E) is the cumulative density function. The RMA (E) curve fits the data points 300 together to provide a continuous measure of percentage of residual toner mass per area compared to transfer field voltage. The curve 304 represents the probability density function (field detachment distribution or PDF(E)) which is proportional to the slope of the RMA(E) curve 302. In embodiments herein, the calculator 112 fits a Gaussian cumulative distribution function 304 to the measured RMA vs. field curve 300 by using a least squares fit and varying the mean and standard deviation. The resulting Gaussian probability distribution is plotted in FIG. 3 as item 304 (scale=arbitrary units to fit on plot).

It is desirable to have the lowest percentage of toner mass remaining on the drum/belt after transfer and, therefore, the normal operating point of the printing engine will be at a transfer field that produces nearly zero percentage RMA. In the examples shown in FIG. 3, this point occurs between about 3000–4000 volts. Above this point where the transfer field is too high, the percentage of RMA begins to increase again.

As shown in FIG. 3, above the maximum allowable field (above about 4000 V) the RMA increases due to a combination of wrong sign toner generation (air breakdown) and increased adhesion (attraction between the field induced dipole in the toner and its image dipole in the drum surface). At the nominal operating point (Ibtr~25 uA, Vbtr–Vlow~3185V, $E_{PEAK}$~57 V/um) the transfer efficiency for toner is nearly 100% (99.8+/–0.4% according to the measurements). The average detachment field from the guassian probability density function 304 is $V_{BTR}-V_{LOW}$=1296 V, and the width, or standard deviation, of the guassian probability density function 304 is 753 V.

Figure 4:
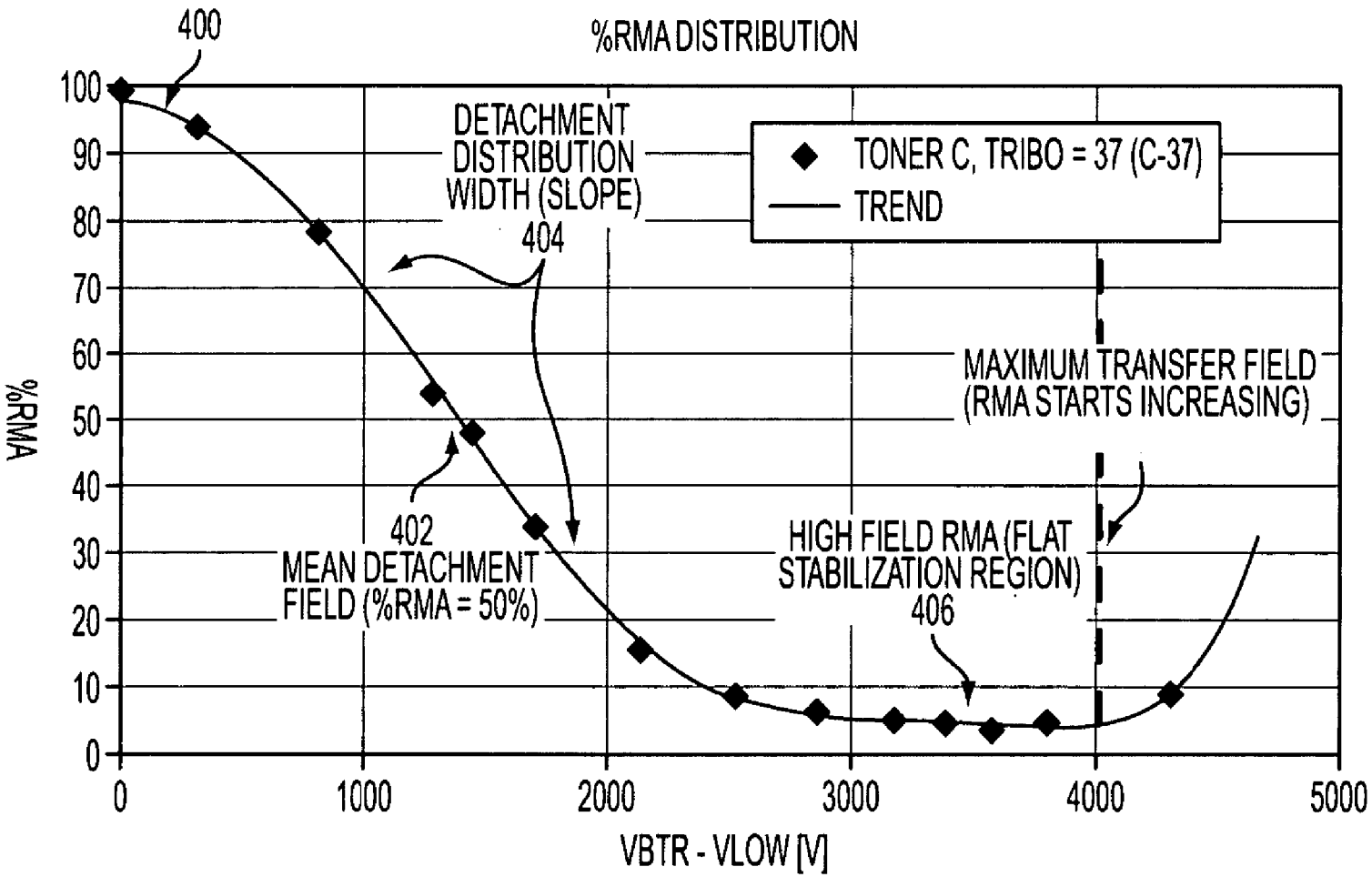
FIG. 4 is a graph illustrating a curve relationship between percentage of RMA distribution.

FIG. 4 illustrates a curve of the relationship between percentage of remaining mass/area and transfer field charge 400 that is achieved with the residual mass/area of sensor 108, controller 110, and a calculator 112 using an older toner sample having a tribo of 37 (C-37 toner). More specifically, in FIG. 4, the curve 400 is measured as a function of transfer field using the residual mass/area of sensor 108, controller 110, and a calculator 112.

FIG. 4 is utilized to illustrate some features of the field detachment distribution that are sensitive to the toner state (or toner characteristics/properties). The peak transfer field (X-axis) is linearly related to $V_{BTR}-V_{LOW}$ for a biased transfer system like this, where $V_{BTR}$ is the voltage applied to the BTR shaft (the charged transfer device 114) and $V_{LOW}$ is the photoreceptor (drum/belt 100) discharge potential in the imaged areas. Alternatively, the curves could be plotted as a function of estimated peak field by using a simple analytic model (see, for example, the table in FIG. 5 which shows the field at various $V_{BTR}-V_{LOW}$ set-points). In the table in FIG. 5, $V_{HI}$ is the charge potential of the photoreceptor in the non-imaged areas, $I_{BTR}$ is the BTR dynamic current, and $E_{PEAK}$ is the transfer field in V/μm calculated using a simple analytic model. With respect to interpreting the transfer RMA detachment field distribution, there is a straightforward relationship between the RMA as a function of field 300 (i.e., RMA(E)) and the field detachment distribution. The cumulative distribution function is simply CDF (E)=100–RMA(E), and the Gaussian probability density function is the derivative/slope of CDF(E). The Gaussian fit 304 (FIG. 3) indicates that the mean detachment voltage is ΔV=Vbtr–Vlow=1300V±750 V, where ±750V is the standard deviation.

Much information can be extracted from the RMA(E) and the detachment field distribution. For example, the RMA data curve 400 can be utilized to determine whether there is a high field residual 406. The high field residual 406 is determined by observing the flat part of the RMA data curve 400. This flat portion of the RMA data curve 400 is sometimes referred to herein as "stabilization condition" because the percentage of RMA remains relatively stable over a range of different transfer field voltages. The percentage of remaining toner mass/area is referred to herein sometimes as the "stabilization toner mass per area."

Figure 6:
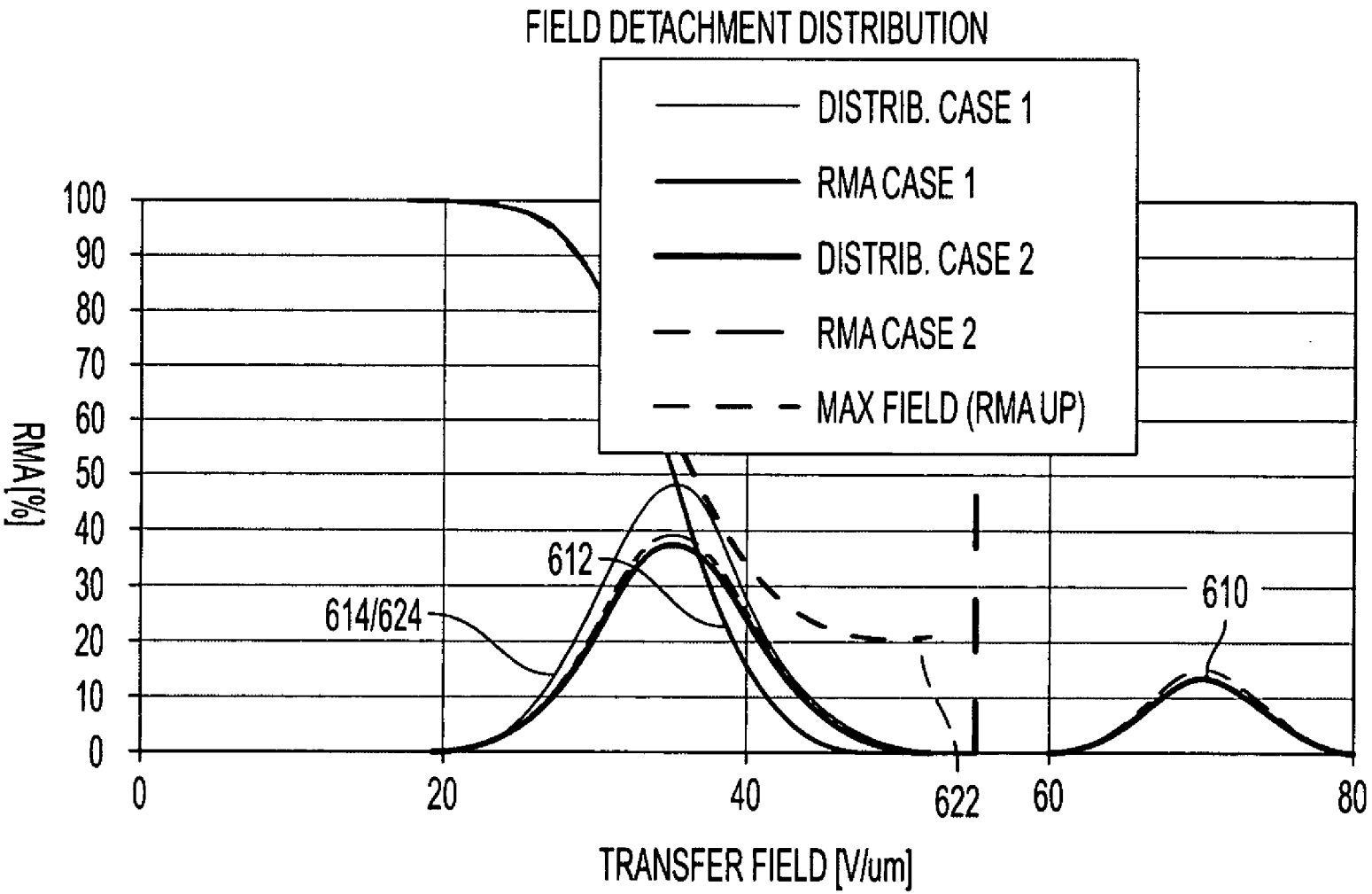
FIGS. 6–9 are graphs illustrating field detachment distributions.
Figure 7:
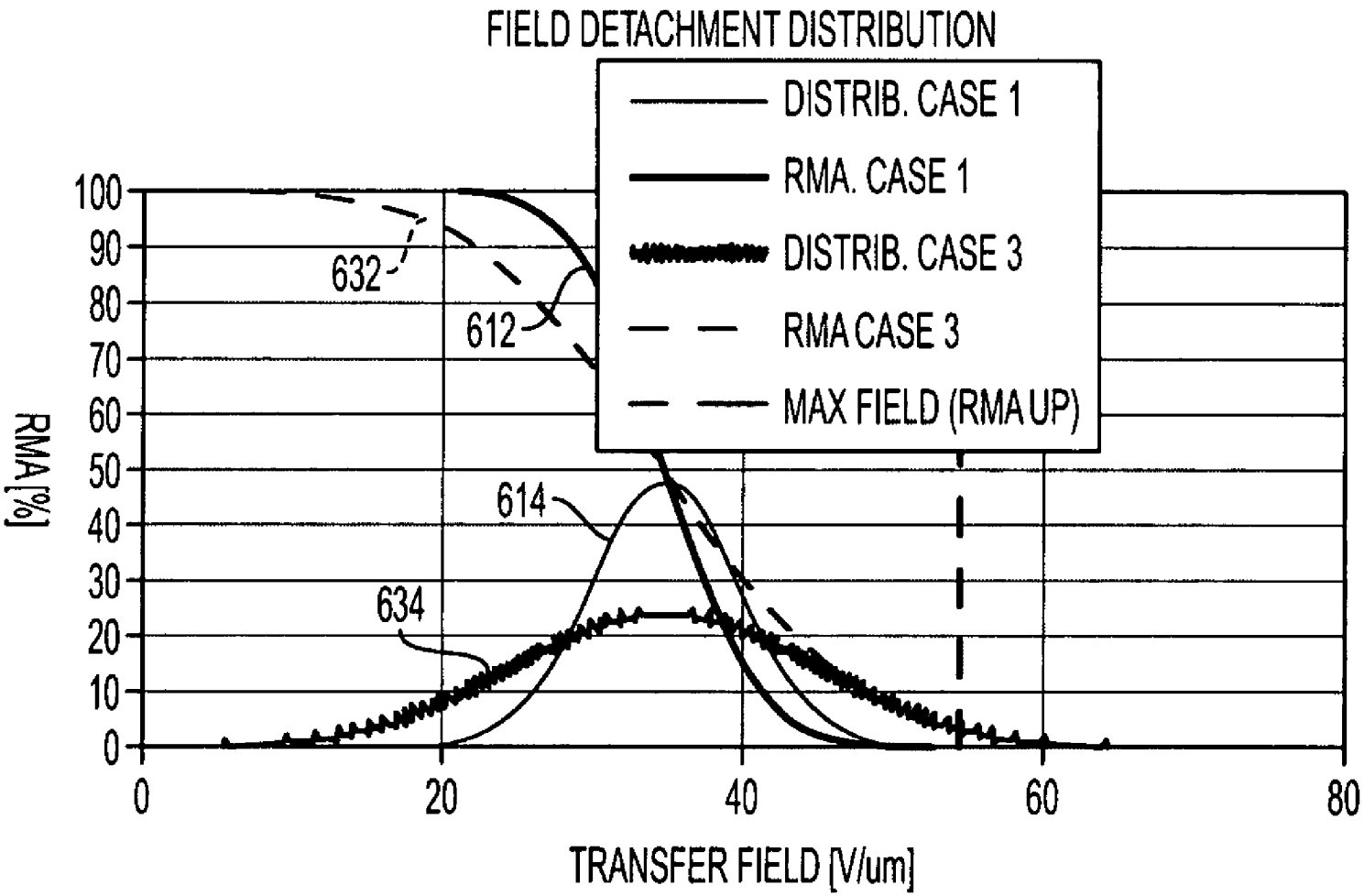
Figure 8:
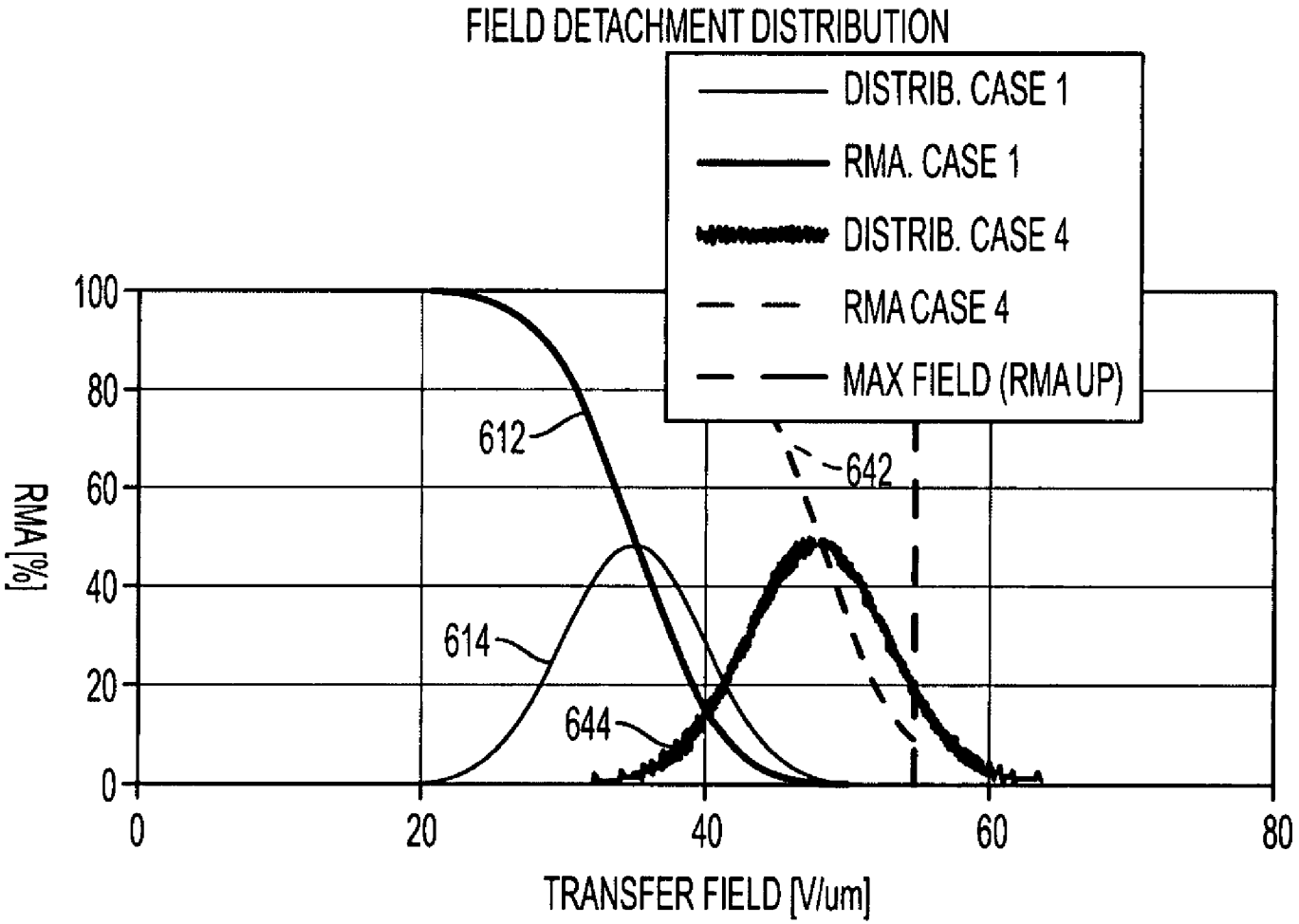

Four different "cases" or examples are shown in FIGS. 6–8. Cases 1 and 2 are shown in FIG. 6. Cases 1 and 3 are shown in FIG. 7 and cases 1 and 4 are shown in FIG. 8. Lines 612 and 614 illustrate case 1; lines 622 and 624 illustrate case 2; lines 632 and 634 illustrate case 3; and lines 642 and 644 illustrate case 4.

Case 2 in FIG. 6 illustrates a situation where the stabilization toner mass per area is increased (622) when compared to the stabilization toner mass per area for case 1 (612). More specifically, while the probability density function for case 1 (614) is substantially similar to the probability density function for case 2 (624), the stabilization toner mass per area is increased for case 2 when compared to case 1. This higher stabilization toner mass per area 622 for case 2 (higher field residual) may indicate a sub-distribution of "extreme toners" that are difficult to detach, or wrong sign toner that cannot be removed by an electric field with the applied polarity. These extreme toners are represented as an abnormal rise in the probability distribution function above the maximum transfer field as shown by portion 610 of RMA distribution curve 624 in FIG. 6. The extreme toner particles may include toner fines or large particles, extreme toner shapes, or toners with poor additive area coverage.

In addition, as shown in FIG. 4, the width 404 of the detachment field distribution can be identified. As mentioned above, the detachment distribution width 404 can also be called the standard deviation of the "probability density function" which is related to the "slope" of the cumulative distribution function that is fit to the RMA data curve 400. The slope of the RMA Vs field curve 400 is related to the width of the distribution. A high slope indicates a tight distribution, and a gradual slope indicates a broad distribution. As shown in FIG. 4, toner C (conventional grind toner) has a fairly broad distribution centered at $\Delta V=1400V$. Fortunately, almost all of the toner can be detached at operating voltages of about $\Delta V=3180V$ which is less than the maximum allowable voltage of $\Delta V\sim3800$ (voltage where RMA begins to increase). An increase in the width of the distribution may indicate a broadening of the toner properties that impact adhesion (see FIG. 7, case 3). Toner aging in the development sump, for example, could result in a broader distribution. More specifically, as shown in FIG. 6, while the case 1 RMA data curve 612 operates at similar field voltage levels as the case 3 in FIG. 7 RMA data curve 632, the slopes of the two curves are different. The difference in the slopes can be seen by comparing the case 1 probability density function 614 with the case 3 probability density function 634. The case 3 probability density function 634 is substantially less than the case 1 probability density function 614 indicating that the case 1 RMA data curve 612 has a higher slope than the case 3 RMA data curve 632. Again, this increase in the width of the distribution shown by the case 3 probability density function 634 may indicate a broadening of the toner properties that impact adhesion for the case 3 toner.

Further, the mean detachment field 402 can be identified. The mean detachment field 402 is the point where the RMA=50%. Half the toners detach at a higher field and half detach at a lower field. This mean 402 represents the detachment field of an "average" typical toner particle. A shift in the mean detachment field 402 may indicate a toner property shift that impacts all of the toners in the distribution. See FIG. 8, case 4 for an example of this sort of shift in the distribution. More specifically, case 4 is shown in FIG. 8, which is a graph that compares case 1 RMA data 612 with case 4 RMA data 642. In FIG. 8, data curve 642 is shifted toward higher field voltages when compared to data curve 612. The field detachment distribution 644 is similarly shifted to higher field voltages when compared to case 1 field detachment distribution 614. When the mean detachment field of case 1 is compared to the mean detachment field of case 4, case 4 will show an increased transfer field voltage for the mean detachment field, which may indicate a changing toner characteristics.

The RMA data curve 400 can also be utilized to determine the maximum transfer field 408. At very high fields ($V_{BTR}-V_{LOW}>4000V$) the RMA starts to increase with field as shown in FIG. 4. This could be caused by, for example, a combination of wrong sign toner generation (air breakdown) and/or increased image dipole adhesion (attraction between the field induced dipole in the toner and its image dipole in the OPC surface). An increase in the size distribution of the toner could result in air gaps that shift the maximum allowable field downward. Thus, the maximum transfer field 408 is determined to be the point just before the RMA data curve 400 begins to increase after the end of the stabilization condition.

To measure the RMA vs. transfer field, measurements may be conducted during cycle up, during periodic diagnostic setups, or during print runs using solid area printing patches in the ID zone (for transfer to an intermediate belt/member). It may not be necessary to measure the entire RMA vs. field curve at high resolution in order to diagnose the toner state. Shifts in the mean detachment field could be determined by measuring the RMA at only one point on the steep portion of the RMA curve. Changes in the width of the distribution could be monitored by measuring the RMA at two or perhaps three fields at the steep portion of the RMA curve. The high field (or stabilization) RMA could be determined by measuring one point in the flat region of the curve, and shifts in the maximum field could be determined by measuring a few points near the maximum field threshold. In general, it would be advisable to measure several patches at each field set-point and calculate the average value to reduce the noise.

Figure 9:
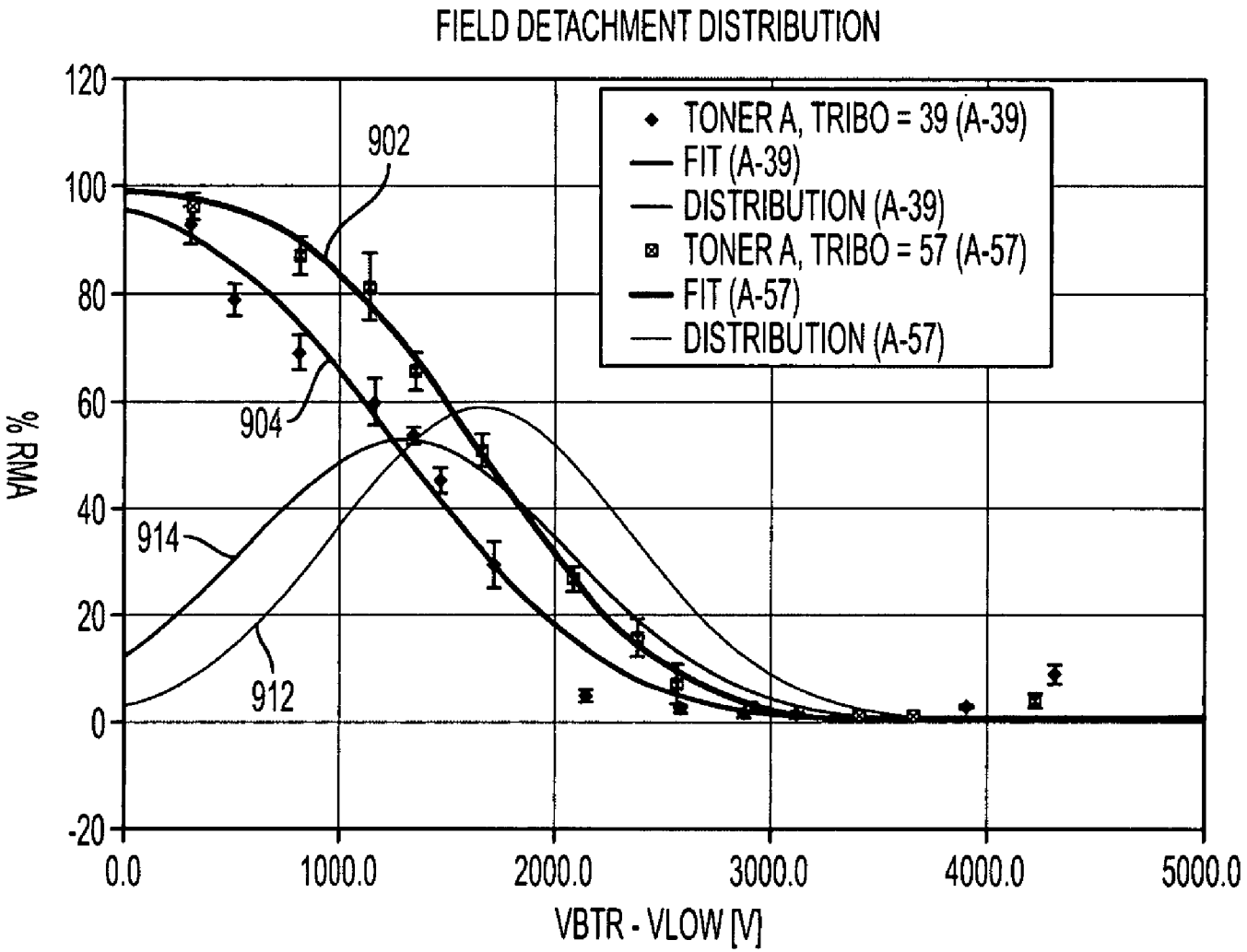

With respect to the relationship of detachment field distribution to the adhesion distribution, the detachment field distribution is highly dependent on the adhesion distribution, but they are not exactly equivalent. The fields build up somewhat gradually in the transfer nip. Therefore, the low adhesion toner that transfers first will, in principal, create a repulsive field (negative charge) that opposes the transfer of the higher adhesion particles. This would tend to broaden the detachment distribution, since this effect is not accounted for in the measurement of the "field axis" (=x-axis). However, this effect is minor. Increasing the tribo actually narrows the distribution slightly. For example, as shown in FIG. 9, RMA data curve 902 has a higher tribo (57 μC/g) than RMA data curve 904 (39 μC/g). Data curve 902 has a higher slope than data curve 904. Thus, in this situation, the probability density function 912 of the A-57 RMA data curve 902 is more narrow than the probability density function 914 of the A-39 RMA data curve 904. This suggests that most of the toner transfers at very small air gaps, so the repulsive field of the initially-transferred low-adhesion toner is negligible. According to Gausses law (far field approximation), the repulsive field would be extremely large if the transfer gap were much larger than a typical toner diameter, and it would be expected that width of the distribution, as measured, would be distorted by this effect if the transfer gaps were larger than they appear to be. Therefore, the properties of the detachment field are primarily driven the adhesion distribution of the toner.

Figure 10:
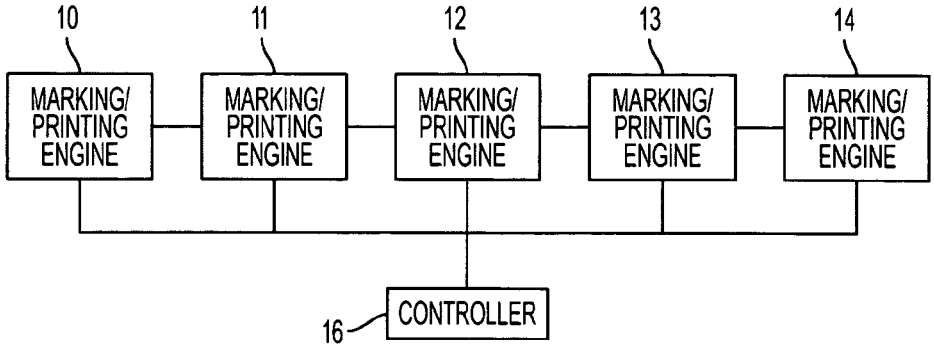
FIG. 10 is a schematic representation of a printing network.

While the foregoing discusses the system with respect to comparisons with predetermined values and standards, the system can also be utilized with relative comparisons of similarly operating machines, as shown in FIG. 10. For example, sometimes groups of printing engines 10–14 will be networked together and the printing from each of the different engines should be consistent so that there is little or no variation from printing engine to printing engine. Each printing engine can have multiple marking engines. A printing engine generally has a paper feeder, one or more marking engines, and a finisher (output device), a portion of a marking engine is shown in FIG. 1. The printing engines may be either contained within a group of externally networked print engines (print engine=feeder+marker+finisher), and/or there may be multiple marking engines within one print engine (an "internal" network). For such printing networks, a controller 16 can alter the operating parameters of the printing system based on comparisons of the different field detachment distributions of the different marking engines 10–14 within the printing network. Thus, the controller 806 can monitor toner attributes in a plurality of different printing and/or marking devices 10–14, compare the toner attributes, and alter operating parameters of the printing and/or marking devices 10–14 depending upon the toner attributes to promote printing uniformity between the different printing and/or marking devices 10–14.

Figure 11:
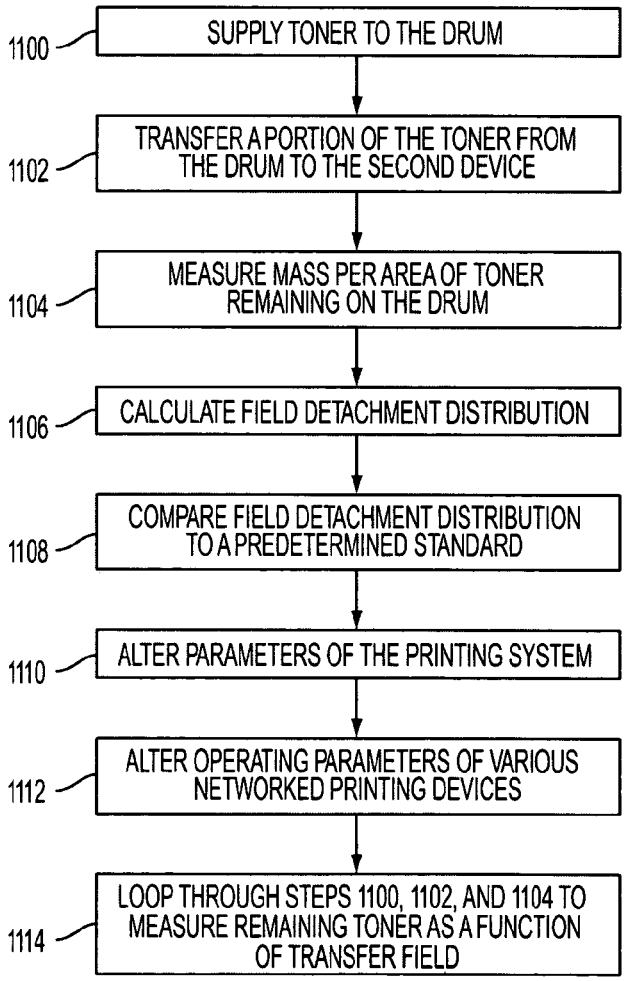
FIG. 11 is a flow diagram illustrating one embodiment of the invention.

The flowchart shown in FIG. 11 illustrates the method for monitoring toner characteristics in a printing system. In item 1100 the method supplies toner to the drum/belt and in item 1102, at least a portion of the toner is transferred from the drum/belt to the surface. The mass per area of toner remaining on the drum/belt as the drum/belt transfers the toner to the surface is measured while varying the transfer field of the charged transfer device in item 1104. As shown by item 1114, the process loops through steps 1100, 1102, 1104 while changing the transfer field to measure the remaining toner as a function of transfer field. The field detachment distribution is calculated in item 1106 based on changes in the mass per area of toner remaining as the transfer field of the charged transfer device is varied. The field detachment distribution is compared to a predetermined standard to evaluate characteristics of the toner in item 1108. The operating parameters of the printing system are altered in item 1110 based on results of the comparing of the field detachment distribution to the predetermined standard. In item 1112, the operating parameters of various networked printing devices can be altered depending upon the relative comparison of different printing engines' toner attributes, to promote printing uniformity between the different printing devices.

With the foregoing embodiments, the toner state is determined by varying the transfer field and measuring the transfer residual mass (RMA) at several field values. This measurement determines the toner detachment field distribution, which makes it very similar to an in-situ toner adhesion measurement. The width and mean (as well as other properties) of the detachment field distribution are highly dependent on key toner properties, including those that impact toner adhesion. These properties include (but are not limited to) toner tribo, toner charge distribution, toner size and shape distribution, toner additive state, toner age, etc. This direct method of measuring the toner state can be used in more effective control schemes to improve printer engine latitude and performance.

Thus, embodiments herein have many applications where toner properties can be sensed. The detachment field distribution is sensitive to several properties of the toner. The distributions will be particularly sensitive to shifts in properties that impact toner adhesion. The toner properties include shifts in mean or width of the toner tribo distribution and embodiments herein can comprise as a tribo sensor. The additive impaction and toner aging can lead to increased adhesion and/or broadening of the adhesion distribution, leading to shifts in the detachment distribution, and embodiments herein can be used to detect the additive impaction and toner aging. Shifts in the charge distribution on the surface of the toner also affect printing quality. Uniformly charged toner has lower adhesion than patch charged toner. The uniformity of the charge may vary over time and embodiments herein comprise charge distribution sensors. Shifts in the mean or width of the toner size and/or shape distribution also affect printing quality. An increasing fraction of course (large) toner particles could lead to a reduction in the maximum allowable transfer field due to a lower air breakdown threshold for wrong sign toner generation. The high field RMA may also increase if the fraction of "extreme" hard to detach toner particles increases and embodiments herein can be used to measure these characteristics.

While the foregoing has been described in conjunction with various exemplary embodiments, it is to be understood that many alternatives, modifications and variations would be apparent to those skilled in the art. Accordingly, Applicants intend to embrace all such alternatives, modifications and variations that follow in this spirit and scope.

What is claimed is:

1. A method for monitoring toner characteristics in a printing system, said method comprising:

supplying toner to a first device; transferring at least a portion of said toner from said first device to a surface using a charged second device;

measuring an amount of toner remaining on said first device as said first device transfers said toner to said surface, while varying an electrical charge of said charged second device;

calculating a field detachment distribution based on changes in said amount of toner remaining as said electrical charge of said charged second device is varied;

comparing said field detachment distribution to a predetermined standard to evaluate characteristics of said toner; and altering operating parameters of said printing system based on results of said comparing of said field detachment distribution to said predetermined standard.

2. The method according to claim 1, wherein said comparing comprises detecting a difference between a mean detachment field and a predetermined mean detachment field.

3. The method according to claim 1, wherein said comparing comprises detecting a difference between a probability density function of said field detachment distribution and a predetermined field detachment distribution probability density function.

4. The method according to claim 1, wherein said comparing comprises detecting a difference between a stabilization toner amount remaining after said varying of said electrical charge reaches a stabilization point and a predetermined stabilization toner amount.

5. The method according to claim 1, wherein said comparing comprises detecting a difference between an observed maximum transfer field and a predetermined maximum transfer field.

6. The method according to claim 1, further comprising:

monitoring toner attributes in a plurality of different printing devices; and comparing said toner attributes;

altering operating parameters of said printing devices depending upon said comparing of said toner attributes to promote printing uniformity between said different printing devices.

7. A method for monitoring toner characteristics in a printing system, said method comprising:

supplying toner to a drum/belt comprising one of a drum and a belt;

transferring at least a portion of said toner from said drum/belt to said surface using a charged transfer device;

measuring a mass per area of toner remaining on said drum/belt as a drum/belt transfers said toner to said surface, while varying a transfer charge of said charged transfer device;

calculating a field detachment distribution based on changes in said mass per area of toner remaining as said transfer charge of said charged transfer device is varied;

comparing said field detachment distribution to a predetermined standard to evaluate characteristics of said toner; and altering operating parameters of said printing system based on results of said comparing of said field detachment distribution to said predetermined standard.

8. The method according to claim 7, wherein said comparing comprises detecting a difference between a mean detachment field and a predetermined mean detachment field.

9. The method according to claim 7, wherein said comparing comprises detecting a difference between a probability density function of said field detachment distribution and a predetermined field detachment distribution probability density function.

10. The method according to claim 7, wherein said comparing comprises detecting a difference between a stabilization toner mass per area remaining after said varying of said transfer charge reaches a stabilization point and a predetermined stabilization toner mass per area.

11. The method according to claim 7, wherein said comparing comprises detecting a difference between an observed maximum transfer field and a predetermined maximum transfer field.

12. The method according to claim 7, further comprising:

monitoring toner attributes in a plurality of different printing devices; and comparing said toner attributes;

altering operating parameters of said printing devices depending upon said comparing of said toner attributes to promote printing uniformity between said different printing devices.

13. A system adapted to monitor toner, said system comprising:

a first device;

a toner source adapted to supply toner to said first device;

a surface adjacent said first device, wherein said first device is adapted to transfer at least a portion of said toner to said surface;

a charged second device adjacent said surface, wherein said surface is between said first device and said charged second device;

a toner area coverage sensor adjacent said first device, wherein said toner area coverage sensor is adapted to measure an amount of toner remaining on said first device;

a controller connected to said toner area coverage sensor and to said charged second device, wherein said controller is adapted to control said toner area coverage sensor to detect said amount of toner remaining on said first device as said first device transfers said toner to said surface, while varying an electrical charge of said charged second device;

a calculator adapted to calculate a field detachment distribution based on changes in said amount of toner remaining as said electrical charge of said first device is varied; and a comparator adapted to compare said field detachment distribution to a predetermined standard to evaluate characteristics of said toner.

14. The system according to claim 13, wherein said comparator is adapted to detect a difference between a mean detachment field and a predetermined mean detachment field.

15. The system according to claim 13, wherein said comparator is adapted to detect a difference between a probability density function of said field detachment distribution and a predetermined field detachment distribution probability density function.

16. The system according to claim 13, wherein said comparator is adapted to detect a difference between a stabilization toner amount, remaining after said varying of said electrical charge reaches a stabilization point, and a predetermined stabilization toner amount.

17. The system according to claim 13, wherein said comparator is adapted to detect a difference between an observed transfer field and a predetermined maximum transfer field.

18. The system according to claim 13, wherein said system is adapted for use with a printing system and said controller is adapted to alter operating parameters of said printing system based on results of said comparing of said field detachment distribution to said predetermined standard.

19. The system according to claim 13, wherein said system is adapted for use with a printing system and said controller is adapted to:

monitor toner attributes in a plurality of different printing devices;

compare said toner attributes; and alter operating parameters of said printing devices depending upon said comparing of said toner attributes to promote printing uniformity between said different printing devices.

20. A system adapted to monitor toner in a printing engine, said system comprising:

a drum/belt comprising one of a drum and a belt;

a toner source adapted to supply toner to said drum/belt;

a surface adjacent said drum/belt, wherein said drum/belt is adapted to transfer at least a portion of said toner to said surface;

a charged transfer device adjacent said surface, wherein said surface is between said drum/belt and said charged transfer device;

a toner area coverage sensor adjacent said drum/belt, wherein said toner area coverage sensor is adapted to measure a mass per area of toner remaining on said drum/belt;

a controller connected to said toner area coverage sensor and to said charged transfer device, wherein said controller is adapted to control said toner area coverage sensor to detect said mass per area of toner remaining on said drum/belt as said drum/belt transfers said toner to said surface, while varying a transfer charge of said charged transfer device;

a calculator adapted to calculate a field detachment distribution based on changes in said mass per area of toner remaining as said transfer charge of said charged transfer device is varied; and a comparator adapted to compare said field detachment distribution to a predetermined standard to evaluate characteristics of said toner.

21. The system according to claim 20, wherein said comparator is adapted to detect a difference between a mean detachment field and a predetermined mean detachment field.

22. The system according to claim 20, wherein said comparator is adapted to detect a difference between a probability density function of said field detachment distribution and a predetermined field detachment distribution probability density function.

23. The system according to claim 20, wherein said comparator is adapted to detect a difference between a stabilization toner mass per area, remaining after said varying of said transfer charge reaches a stabilization point, and a predetermined stabilization toner mass per area.

24. The system according to claim 20, wherein said comparator is adapted to detect a difference between an observed maximum transfer field and a predetermined maximum transfer field.

25. The system according to claim 20, wherein said system is adapted for use with a printing system and said controller is adapted to alter operating parameters of said printing system based on results of said comparing of said field detachment distribution to said predetermined standard.

26. The system according to claim 20, wherein said system is adapted for use with a printing system and said controller is adapted to:

monitor toner attributes in a plurality of different printing devices;

compare said toner attributes; and alter operating parameters of said printing devices depending upon said comparing of said toner attributes to promote printing uniformity between said different printing devices.

* * * * *